United States Patent [19]

Elmasry et al.

[11] Patent Number: 4,946,753

[45] Date of Patent: Aug. 7, 1990

[54] LIQUID ELECTROPHOTOGRAPHIC TONERS

[75] Inventors: Mohamed A. Elmasry, Woodbury, Minn.; Gregory L. Zwadlo, Ellsworth, Wis.; Kevin M. Kidnie, St. Paul, Minn.

[73] Assignee: Minnesota Mining and Manufacturing Company, St. Paul, Minn.

[21] Appl. No.: 279,424

[22] Filed: Dec. 2, 1988

[51] Int. Cl.[5] ..... G03G 13/01

[52] U.S. Cl. ..... 430/45; 430/47; 430/114; 430/115

[58] Field of Search ..... 430/114, 47, 45, 115

[56] References Cited

U.S. PATENT DOCUMENTS

| | | | |
|---|---|---|---|
| 3,753,760 | 8/1973 | Kosel | 117/37 LE |
| 3,900,412 | 8/1975 | Kosel | 252/62.1 |
| 4,081,391 | 3/1978 | Tsubuko et al. | 252/62.1 |
| 4,155,862 | 5/1979 | Mohn et al. | 252/62.1 |
| 4,264,699 | 4/1981 | Tsubuko et al. | 430/112 |
| 4,275,136 | 6/1981 | Murasawa et al. | 430/117 |
| 4,480,022 | 10/1984 | Alexandrovich et al. | 430/119 |
| 4,525,446 | 6/1986 | Uytterhoeven et al. | 430/117 |
| 4,547,449 | 10/1985 | Alexandrovich et al. | 430/115 |
| 4,564,574 | 1/1986 | Uytterhoeven et al. | 430/115 |
| 4,606,989 | 8/1986 | Uytterhoeven et al. | 430/106 |

OTHER PUBLICATIONS

"Research into the Electrokinetic Properties of Electrophotographic Liquid Developers", Muller et al., IEEE Transactions on Industry Applications, vol. 1A-16, p. 771, 1980.

*Primary Examiner*—Paul R. Michl
*Assistant Examiner*—Jeffrey A. Lindeman
*Attorney, Agent, or Firm*—Donald M. Sell; Walter N. Kirn; Mark A. Litman

[57] ABSTRACT

Liquid toners are generally recognized as being capable of providing sharper electrophotographic images, but have been found to provide less than desirable results in multicolor imaging processes. The selection of a unique combination of (a) the ratio of conductivities between the toner liquid and the total toner composition, and (b) the zeta potential of the toner particles in the carrier liquid have been found to provide unique benefits to the quality of the liquid toned multicolor images.

20 Claims, No Drawings

LIQUID ELECTROPHOTOGRAPHIC TONERS

BACKGROUND TO THE INVENTION

1. Field of the Invention

The invention relates to processes for using electrophotographic systems to make and assemble a number of color toned images to give a full color reproduction. More particularly the invention relates to the use of such systems to make accurate color proofs for the printing industry.

2. Background of the Art

Full color reproductions by electrophotography have been generally known for many years (e.g., U.S. No. 2,297,691) but no detailed mechanisms were described and the toners disclosed were dry powders. U.S. Pat. Nos. 2,899,335 and 2,907,674 pointed out that dry toners had many limitations with respect to image quality used for superimposed color images. Liquid toners were recommended for the purpose of improved image quality. These toners comprised carrier liquids which were of high resistivity, e.g. $10^9$ ohm-cm or more, with colorant particles dipersed in the liquid, and preferably an additive intended to enhance the charge carried by the colorant particles. U.S. No. 3,337,340 disclosed that one toner deposited first may be sufficiently conductive to interfere with a succeeding charging step. It was claimed that the use of resins which are both insulative (resistivity greater than $10^{10}$ ohm-cm) and a of low dielectric constant (less than 3.5) to cover each colorant particle was necessary to provide good images. U.S. No. 3,135,695 disclosed toner particles stably dispersed in an insulating aliphatic liquid, the toner particles comprising a charged colorant core encapsulated by an aromatic soluble resin treated with a small quantitiy of an aryl-alkyl material.

The use of metal soaps as charge contol and stabilizing additives to liquid toners is disclosed in many earlier patents (e.g. U.S. No. 3,900,412; U.S. No. 3,417,019; U.S. No. 3,779,924; U.S. No. 3,788,995). (Concern has also been expressed and corrective measures offered for the inefficient action experienced when charge control additives or other charged additives migrate from the toner particles into the carrier liquid (U.S. No. 3,900,413; U.S. No. 3,954,640; U.S. No. 3,977,983; U.S. No. 4,081,391; U.S. No. 4,264,699). In U.S. No. 3,890,240 it is disclosed that typical liquid toners known in the art have conductivities in the range $1\times10^{-11}$ to $10\times10^{-11}$ mho/cm. GB No. 2,023,860 discloses centrifuging the toner particles out of a liquid toner and redispersing them in fresh liquid as a way of reducing conductivity in the liquid itself. After repeating the process several times the conductivity of the liquid toner was reduced by a factor of about 23 and was disclosed as a sensitive developer for low contrast charge images.

In several patents the idea is advanced that the level of free charge within the liquid toner as a function of the mass of toner particles is important to the efficiency of the developing process. In U.S. No. 4,547,449 this measure was used to evaluate the unwanted charge buildup on replenishment of the toner during use, and in U.S. No. 4,606,989 it was used as a measure of deterioration of the toner on aging. In U.S. No. 4,525,446 the aging of the toner was measured by the charge present and it was shown how the charge was generally related to the zeta potential of the individual particles. U.S. No. 4,564,574, discloses chelating charge director salts onto the polymer, used in liquid toners and discloses measured values of zeta potential on toner particles. Values of 33 mV and 26.2 mV with particle diameters of 250 nm and 400 nm are given. The purpose of the salts is to improve stability of the liquid toner. A literature reference, "Research into the Electrokinetic Properties of Electrographic Liquid Developers", V. M. Muller et al, IEE on Industry Applications, vol. 1A-16, pages 771–776 (1980), treats the liquid toner system theoretically but also gives experimental results on certain toners. Using very small toner particles (all less than about 0.1 micron), zeta potentials in the range 15 mV to 99 mV with related conductivity ratios were used. These latter ratios appear to relate the conductivity of the toner immediately after the current is initiated to the conductivity value after prolonged passage of the current. The former values are believed to contain both toner particle and soluble ionic species conductivities; the latter is believed to be the basic conductivity of the carrier liquid after most of the added charged carriers have been deposited by the current flow. Finally in U.S. No. 4,155,862 the charge per unit mass of the toner was related to difficulties experienced in the art in superposing several layers of different colored toners. This latter problem was approached in a different way in U.S. No. 4,275,136 where adhesion of one toner layer to another was enhanced by an aluminum or zinc hydroxide additive on the surface of the toner particles.

Diameters of toner particles in liquid toners vary from a range of 2.5 to 25.0 microns in U.S. No. 3,900,412 to values in the sub-micron range in U.S. No. 4,032,463 U.S. No. 4,081,391, and U.S. No. 4,525,446, and are even smaller in the Muller paper. It is stated in U.S. No. 4,032,463 that the prior art makes it clear that sizes in the range 0.1 to 0.3 microns are not preferred because they give low image densities.

Liquid toners which provide developed images which rapidly self-fix to a smooth surface at room temperature after removal of the carrier liquid are disclosed in U.S. No. 4,480,022 and U.S. No. 4,507,377. These toner images are said to have higher adhesion to the substrate and to be less liable to crack. No disclosure is made of their use in multicolor image assemblies.

The art therefore discloses an awareness of the importance of the physical parameters of the liquid toner-conductivities, zeta potentials of toner particles, charge per particle or per unit mass of particles, and the localization of the charge on the particles. Most of the references above are concerned with the efficiency of liquid toners in the context of monochomatic image development. Only U.S. No. 4,155,862 and U.S. No. 4,275,136 are explicitly concerned with multicolor toned images, and only the first of these relates the quality of the multicolor toned assembly to the charge per gram of the toner particles.

SUMMARY OF THE INVENTION

The invention provides a process for making high quality color images by electrophotography, wherein two or more different colored toner images are assembled on a positively charged photoconductor and are then transferred to a receptor surface. Such a system provides the high degree of control necessary to ensure the levels of accuracy in registration and color rendition required by color proofing and other high quality multicolor imaging processes. The invention further provides for liquid toners which when used one overlaying another to make these multicolor images, give good reproduction without image distortion or density loss, e.g. give greater than 85% trapping. The assembled image layers are capable of transfer together to a receptor surface in one or two steps without image loss.

This disclosure shows that novel liquid toners of the present invention may be uniquely characterized by two parameters:

(a) more than 40% of the conductivity is contributed by the charged toner particles as opposed to the ionic species in solution in the carrier liquid, (b) the charge on the toner particles is of such a magnitude that the zeta potential of the particles are within a defined range around +140 mV.

This disclosure further shows that in the production of multicolor images the efficiency of overlaying of such liquid toner developers is enhanced by the satisfaction of a third parameter requirement, namely (c) toner particle compositions which form a continous film immediately after deposition on the photoconductor surface and removal of the carrier liquid.

Two related prior art patents U.S. No. 4,507,377 and No. 4,480,022 may be relevant to parameter (c) in that they disclose and claim Tg in the range 30° C. and −10° C. as a means to self-fix the deposited toner to a smooth surface without requiring a subsequent heating treatment; two other related patents (U.S. No. 4,525,446 and 4,564,574) and the Muller et al paper disclose the use of the parameter zeta potential as a descriptive mechanism of toner properties and disclose zeta potential values for toners. These patents use zeta potential values only to determine the sign of the charge on the toner particles, while the Muller paper has a wider interest particularly in the control of particle size and dispersion stability. The above patents and the Muller paper discuss the need to reduce the total number of charged species in solution in the carrier liquid without recognizing the importance the parameter (a) described above. None of these references presents the parameters either singly or in combination as requirements for faithful multicolor image reproduction when assembling two or more colored toners one on top of another on the photoconductor.

U.S. Pat. No. 4,547,489 is conscious of the requirement of designing the electrical properties of the liquid toner to obtain good overlay properties, but uses simple conductivity values and charge per unit mass of toner as the arbiters. It is shown in the present invention that these parameters are not definative of the required overlay properties. No combination of the references teaches the importance of the two or three parameters found necessary for good overlay properties and the levels and ranges specified here have not been disclosed in the art. Nowhere is it disclosed !hat all the toners in an overlay set must satisfy the parameters.

In addition to the three parameter requirements, the values of conductivity and related to it the solids concentration, and of toner particle size are shown to be of practical importance in any given example of a liquid toner.

In summary, the toners of the present invention comprise a pigment particle having on its exterior surface polymer particles usually of smaller average dimensions than said pigment particle, said polymer particles having charge carrying coordination moieties extending from the surface of said polymeric particles. Polymeric particles in the practice of the present invention are defined as distinct volumes of liquid, gel, or solid material and are inclusive of globules, droplets etc. which may be produced by any of the various known techniques such as latex, hydrosol or organosol manufacturing.

DETAILED DESCRIPTION OF THE INVENTION

In the practice of electrophotography it is more common to use negatively charged photoconductors than positively charged ones. It has been found, however, that static noise is a much more common difficulty with negatively charged photoconductors and is very difficult to eliminate. The present invention is directed towards high quality multicolor images, especially for proofing purposes, for which there is a low tolerance for the effects of static noise. The invention is therefore directed towards a process using positively charged photoconductors and positive-acting, toner development sometimes known as reverse toner development. The liquid toners of the present invention are therefore positively charged.

The liquid toners according to the invention comprise a carrier liquid having a resistivity of at least $10^{13}$ ohm-cm and a dielectric constant less than 3.5, and dispersed in the carrier liquid, colored or black toner particles containing at least one resin or polymer conferring amphipathic properties with respect to the carrier liquid. Optionally at least one moiety is present which acts as a charge directing agent. The said resin or polymer may advantageously have a Tg of less than 25° and preferably less than −10°. We have found that examples of liquid toners represented in the art as positively charged, when used with a positively charged photoconductor, give unacceptable overlay properties of one toner over another, together with low image sharpness and low half tone dot quality. More precisely these prior art toners exhibit unacceptable flow of the toner during imaging which results in distortion of the produced images. Desorption of the charge director from the toner particles is also a common problem. It has been further found that these shortcomings are related to certain electrical and chemical parameters of the liquid toner used.

Liquid toners according to the invention are required to have the following two properties:

(a) a ratio of less than 0.6, preferably less than 0.5, more preferably less than 0.4 and most preferably less than 0.3 between the conductivity of the carrier liquid containing unwanted dissolved ionic species which is present in the liquid toner, and the conductivity of the liquid toner itself, (b) toner particles with zeta potentials between +60 mV and +200 mV. Preferably the potentials have a narrow distribution with at least 80% of the particles being within the broad range and within +/−40 mV of the average zeta potential.

The liquid toner according to our invention preferably also should satisfy the following parameter, (c) deposited toner particles have a Tg of less than 25°.

Additionally, it is advantageous if the toner has the following properties, (d) substantially monodispersed toner particle size with an average diameter in the range 0.1 micron to 1.5 micron, (e) a conductivity in the range $0.1\times10^{-11}$ mho/cm and $2.0\times10^{-11}$ mho/cm with solids concentration in the liquid toner in the range 0.1 wt. % to 2.0 wt. % and preferably 0.2 wt. % to 0.75 wt. %.

The liquid toners we disclose here are stable on keeping and maintain their good properties during use. They produce accurate color rendition by their ability to be overlayed one over another without distortion of the tone or color rendition of the individual toner layers. They give what is known in the printing art as a trapping factor with values greater than 85%. "Trapping factor" is defined as the percentage ratio of the amount of toner deposited over a previously deposited toner layer compared with the amount which would be deposited on the receptor surface free from any previous toner deposition. Finally, they give fast consistent toning action under reverse development conditions.

Another characteristic of the present invention that has previously been alluded to is the ability of the toners to form films rather than lumps of particles upon being deposited on the photoconductor and/or upon being transferred to a receptor sheet or intermediate transfer sheet. This film forming capability of the toners of the present invention is in part due to the capability of providing layer proportions of binder particles (the surrounding polymeric particles of latex, organosol or hydrosol) in the individual toner particles. The technology of U.S. Pat. No. 4,564,574 generally allows for the deposition of only very thin layers of polymer on the surface of the pigment (thought to be on the order of monolayer of the polymer molecules). This would at first glance see to provide for high color densities but there is a distinct problem with the technology. The low proportions of polymer/pigment do not facilitate good adhesion and cohesion of the toner parties. The coating efficiency is low, the toner of the prior art acting more like solid powder toners. The toners adhere only on the surface of the particles forming a porous or reticulated network rather than a film. The maximum proportions of polymer/pigment attainable by this method are about 1:1.

In the present invention, the range of proportions of polymer/pigment in the toner particles is between about 3:2 to 20:1, preferably 3:1 to 18:1, and most preferably between 3.5:1 and 15:1. These proportions enable more of the binder to flow during drying or fusion so that more film or plane-like characteristics exist in the toned image. Transfer of the image from the photoconductor is facilitated and there is a shinier character to the image.

These performance properties are a requirement for an electrophotographic system acceptable for proofing and are advantageous for any such system requiring high quality multicolor imaging. It is an important aspect of the invention that all the toners to be used as an overlay set must satisfy the requirements listed above.

These performance properties will now be related to the physical and chemical properties of the liquid toners which are disclosed above as satisfying these requirements.

(a) Conductivity of a liquid toner has been well established in the art as a measure of the effectiveness of a toner in developing electrophotographic images. A range of values from $1.0\times10^{-11}$ mho/cm to $10.0\times10^{-11}$ mho/cm has been disclosed as advantageous in U.S. No. 3,890,240. High conductivities generally indicated inefficient disposition of the charges on the toner particles and were seen in the low relationship between current density and toner deposited during development. Low conductivities indicated little or no charging of the toner particles and led to very low development rates. The use of charge director compounds to ensure sufficient charge associated with each particle is a common practice. There has in recent times been a realization that even with the use of charge directors there can be much unwanted charge situated on charged species in solution in the carrier liquid. Such unwanted charge produces inefficiency, instability and inconsistency in the development. It has been found in the present invention that at least 40% and preferably at least 80% of the total charge in the liquid toner should be situated and remain on the toner particles. Suitable efforts to localize the charges onto the toner particles and to ensure that there is substantially no migration of charge from those particles into the liquid, give substantial improvements. As a measure of the required properties, the present description uses the ratio between the conductivity of the carrier liquid as it appears in the liquid toner and the conductivity of the liquid toner as a whole. This ratio must be less than 0.6 preferably less than 0.4 and most preferably less than 0.3.

Prior art toners that have been examined have shown ratios much larger than this, in the region of 0.95.

(b) The charge carried by each of the toner particles is known in the art to be important in stabilising the dispersion of the particles in the carrier liquid especially upon long term storage. It has also been found that it is also a prime factor in ensuring the adhesion of the freshly deposited toner particles to the receiving surface whether this is the photoconductor or a previously deposited toner layer. It is believed that the adhesion is connected with the velocity with which the particle impinges on the imaging surface under the influence of the electric bias field produced by the development electrode in the reverse development procedure. The effectiveness of the charge in increasing mobility (and therefore the velocity under the influence of the electric bias field) of the toner particles in the environment of the carrier liquid is measured by the zeta potential of the particle. By definition the zeta potential is the potential gradient across the difuse double layer, which is the region between the rigid layer attached to the toner particle and the bulk of the solution (ref. Physical Chemistry of Surfaces, by Arthur Adamson, 4th.Edition, pages 198–200). The zeta potential was evaluated here from a measurement of toner particle mobility using a parallel plate capacitor arrangement. The capacitor plate area was large compared with the distance between the plates so as to obtain a uniform electric field $E=V/d$ where V was the applied voltage and d the plate separation. The liquid toner filled the space between the plates and the current resulting from the voltage V was monitored with a Keithley 6/6 Digital Electrometer as a function of time. Typically the current was found to show an exponential decay due to the sweeping out of charged ions and charged toner particles. The legitimate assumption was made that the time constant for the toner particles was much longer than that for the ionic species and therefore the two values could be separated in the decay curves. If t is the time constant then the velocity (u) of the charged toner particles under the influence of the field E is $u=d/t$ and the toner mobility (m) is $m=u/E$.

The zeta potential (z) is then given by $z=3\ sm/(2\ ee_o)$ where s is the viscosity of the liquid, $e_o$ is the electric permitivity, and e is the dielectric constant of the carrier liquid. References in the literature to zeta potential of toner particles (U.S. No. 4,564,574 and Muller et al above) are limited to the stabilising effect of the zeta potential on the dispersion of the toner particles in the liquid. We found that the values given in the patent, 26 mV to 33 mV, are too small for the purposes of the present invention.

Although the zeta values in Muller et al are higher, and within the range of those recited in the practice of the present inventions, they are combined with conductivity values much lower than are required. It has also been found that the zeta potential should be relatively uniform in a given toner and be centered within the range +60 mV and +200 mV.

(c) It has been found that toners which remain in a particulate form after deposition on the photoconductor surface or over a previously deposited toner are not satisfactory. Overprinting capability of a toner is related to the ability of the toner particles to deform and coalesce into a resinous film. The coalesced particles permit the creation of a new electrostatic latent image immediately after development so that another image can be overprinted.

Non-coalesced particles tend to retain charge because of poor contact with the surface on which they are deposited, and can prevent proper charging of the photoconductor for the next image. Coalesced particles also tend to form a non-scattering layer with more acceptable optical properties.

It is known in the art to heat toners after deposition to coalesce them into a film, but in the process of this invention the necessity to apply a heat treatment between each of the toner developments would be a serious disadvantage and could interfere with the proper action of the photoconductor. The ability of the deposited toner particles to coalesce and film-form at a given temperature is known to be related to the glass transition temperature, Tg, of the resins or polymers involved (U.S. No. 4,024,292). The resins or polymers used in the toner particles of the invention are therefore defined as having Tg values less than about 25° C. and preferably less than −10° C. so that they coalesce and form a film at the ambient temperature of the process after removal of the carrier liquid at a coating thickness of less than 0.3 microns. This film forming ability can be observed on polyethyleneterephthalate at room temperature.

The coalescence of the toner particles of the invention although not causing unacceptable flow of the deposited image, does give advantageous smoothing of image edges on a microscopic scale. Half-tone dot images formed by laser scan methods frequently have castellated edges unless very high resolution scanning is employed. The toners of the invention in the process of coalescing after deposition smooth out the castellations and give the type of dot favored for burning half-tone plates and which printing personnel regard as a necessary quality.

(d) Size and uniformity of size of the toner particles are important to both the film-forming properties and the zeta potential effectiveness; smaller particles will in general coalesce more easily and, however, higher velocities are obtained with larger ones. Toner particle diameters in the sub-micron range are well known in the art but are mostly in the range of 0.5 micron or more, and in fact some references declare there are difficulties with image density if the size is less than about 0.3 micron. We have found that diameters from about 0.1 microns through to about 0.7 microns are not only acceptable, but that the smaller sizes in the range of from about 0.1 through about 0.3 microns are often advantageous in film-forming and in zeta potential requirements. Typically in the present invention, all size ranges have size distributions of the particles with a standard deviation of less than 25%.

(e) With the conductivity ratios specified above for the present invention, the conductivity of the liquid toner should be in the range $0.1\times10^{-11}$ and $2.0\times10^{-11}$ mho/cm and preferably should be in the range $0.1\times10^{-11}$ and $0.5\times10^{-11}$ mho/cm. Thus the conductivities and the conductivity ratio of a toner according to the present invention are both substantially lower than levels commonly found in the prior art.

The conductivities are also related to the concentration of the charged toner particles in the liquid toner at working strength. Concentration of solids in the range 0.1 wt. % to 2.0 wt. % are generally permissible in this invention. At higher values the development is normally too fast and gives high background development together with a lack of control of maximum density. Values below 0.1 wt. % give very low development rates and therefore lead to incomplete development in the times alloted in the process. The preferred range of concentrations in the liquid toners are found to be 0.2 wt. % to 0.75 wt. %.

It is a requirement of the invention that the physical and chemical properties (a) & (b) should be all satisfied in a liquid toner if the performance requirements of color proofing are to be met. For highest quality images the requirements of parameter (c) should also be met. Ranges of the properties (d) and (e) provide further advantages but are not presented here as definative for high quality multicolor overlay images.

Multicolor electrophotographic processes are herein disclosed in which all of the different toners used satisfy the requirements disclosed above, and thereby ensure good overlay of the successive toner images and give high quality image characteristics. A description of suitable apparatus and processes in which the toners of this invention may be used is to be found in U.S. Pat. No. 4,728,983, which is hereby incorporated by reference. One embodiment of the process and apparatus was as follows.

A metal drum 2 of diameter 20 cm and length 36 cm rotated on journals supported on a substantial frame (not shown) driven by a DC servo motor with encoder and tachometer 10 controlled in speed to 0.42 revolutions per minute by speed controller 12. A layer of photoconductor 4 coated on a plastic substrate 6 having an electrically conductive surface layer, was wrapped around the drum 2 and fixed firmly to it and grounded. The photoconductor comprised bis-5,5'-(N-ethylbenzo(a)carbazolyl)-phenylmethane (BBCPM) in a Vitel PE207 polyester binder, sensitized with an indolenine dye having a peak absorption in solution at a wavelength of 787 nm.

Infra-red light of power 2 mw and wavelength 780 nm emitted by self-modulated laser diode 14 was focused by lens system 16 onto the the photoconductor surface at 38 as a spot with ½ Imax diameter of about 30 microns. The focused beam 40 modulated by signals supplied from memory unit 34 by control unit 32 to laser diode 14, was directed to a rotating two-surface mirror 18 driven by motor 36. The mirror speed of 5600 revolutions per minute and the synchronization of its scans with the image signals to the laser diode 14 were controlled accurately by the control unit 32. The sensor 12 supplied to the control unit 32 signals for start of cycle of rotation of the drum 2 which were used to commence signals to the laser diode 14 for the beginning of picture frame information.

The scorotron 20 charged the surface of the photoconductor 4 to a voltage of about +700 immediately before the exposure point 38. The toning developer unit 22 contained four identical units 24 containing respectively black, cyan, magenta, and yellow liquid toner. In each unit 24 there were means to supply the toner to the surface of a roller 26 which was driven at the same surface speed as the drum 2. Motor means 30 enabled any desired toner station to be selected to engage the roller 26 with the surface of the photoconductor at 28 so that toner was applied to the surface. Means were provided to apply a bias voltage of +350 between the roller 26 and the electrically conducting layer 8.

The complete cycle was repeated for each of the required color separation images. Four color images were laid down in register in the order black, cyan, magenta, and yellow and the resulting assembly transferred to a receptor paper 42 by actuating the drive roller 44 heated to 1200 C and engaging the receptor surface with the photoconductor surface at a pressure of 1.79 kg/cm after the fourth toner image had been laid down. The resulting four color half-tone picture was found to have a highly accurate registration between the separation images and a high level of color fidelity.

The toners of the present invention have low Tg values with respect to most available toner materials. This enables the toners of the present invention to form films at room temperature. It is not necessary for any specific drying procedures or heating elements to be present in the apparatus. Normal room temperature 19°–20 ° C. is sufficient to enable film forming and of course the ambient internal temperatures of the apparatus during operation which tends to be at a higher temperature (e.g. 25°–40° C.) even without specific heating elements is sufficient to cause the toner or allow the toner to form a film. It is therefore possible to have the apparatus operate at an internal temperature of 40° C. or less at the toning station and immediately thereafter where a fusing operation would ordinarily be located.

EXAMPLES

A. Properties of Commercial Liquid Toners

Example 1

Liquid toner concentrates from Hunt Chemical Company were evaluated as follows.

Magenta SN-7102C diluted 40 g/L
Cyan SN-7102B diluted 40 g/L
Yellow SN-7102A diluted 40 g/L The toners were drip diluted and allowed to set overnight before imaging. Measured conductivities were:

Magenta: $10.4\times10^{-11}$ mho/cm
Cyan: $8.9\times10^{-11}$ mho/cm
Yellow: $5.4\times10^{-11}$ mho/cm These toners were imaged onto an organic receptor layer comprising BBCPM charged to +520 volts and discharged with a laser scanner emitting light of wavelength 633 nm to a potential of +60 volts at 1500 scan lines per inch. Reverse development mode was used with a gap of 15/1000 inch between the electrode and the photoconductor the bias potential of the electrode being +350 volts. Dwell time between the development electrodes was 1.5 seconds. The developed images were transferred to a coated paper and evaluated. Each toner as laid down showed a tendancy to flow, thus giving unsharpness and reduced contrast, and there was some appreciable background developed. Attempts to lay down one toner over another with the cyan toner last, were not successful.

Example 2

Liquid toners from Panacopy were evaluated.

Concentrates of magenta, cyan, and yellow toners were diluted to 0.1 wt. % with Isopar G, and held overnight after thorough shaking.

Conductivities of these liquid toners were measured (ctot mho/cm).

Samples of each were centrifuged at 15,000 rpm for 30 mins. to precipitate all solids; conductivities of the remaining liquids were measured (cres mho/cm).

Mobilities and zeta potentials for the toner particles in each of the toners were measured as described above in the detailed description of the invention. Values found were as follows:

| Toner | m cm2/volt.sec | zeta mV |
|---|---|---|
| Magenta | $1.15\times10^{-5}$ | 114 |
| Cyan | $0.88\times10^{-5}$ | 87 |
| Yellow | $0.94\times10^{-5}$ | 94 |

Measured conductivities and ratios were as follows:

| Toner | ctot | cres | cres/ctot |
|---|---|---|---|
| Magenta | $1.27\times10^{-11}$ | $0.86\times10^{-11}$ | 0.68 |
| Cyan | $2.6\times10^{-11}$ | $2.28\times10^{-11}$ | 0.88 |
| Yellow | $1.55\times10^{-11}$ | $0.84\times10^{-11}$ | 0.54 |

Although all of these liquid toners have zeta potentials in the range we claim to be effective for good overlay properties, only one of these toners has a conductivity ratio which is low enough to satisfy our requirement (a), and that is marginal. None of these toners was film-forming at room temperature. This set of toners did not overprint successfully when used in an imaging system similar to that described in Example 1, thus indicating that all the toners in an overlay set must satisfy the requirements put forward in this invention. The liquid toners themselves had low stability and had separated after 3 days standing.

B. Properties of Liquid Toners of the Invention.

These examples relate to liquid toners made by the procedures given in the later examples. These toners were based on small organosol particles surrounding a pigment particle and having attached chelating moieties to which metal soap charge generators were chelated. The inner core of the organosol particles was insoluble in the carrier liquid whereas the outer linking groups were compatible with said liquid thus giving a stable dispersion. Compatibility means the ability of the materials to be associated without rejection, as by dispersibility, solubility, or other physical association. The presence of polar groups for a polar solvent or non-polar group for a non-polar solvent will provide this effect. The metal soap charge generators were firmly attached to the organosol by chelating action so that their migration into the body of the liquid was precluded.

Example 3

A four-color set of toners based on the preparations of Example 4 below were made using hydroxyquinoline (HQ) as a chelating agent for attaching the charge generator, and having an ethylacrylate core of Tg = −12.5° C. Measured properties were:

| SAMPLE | Ctot × $10^{11}$ | Cres × $10^{11}$ | RATIO | M × $10^5$ | ZETA mV | SOLIDS |
|---|---|---|---|---|---|---|
| BLACK | 0.95 | 0.33 | 0.35 | 1.01 | 86.3 | 0.6 wt. % |
| MAGENTA | 0.53 | 0.22 | 0.42 | 0.71 | 60.7 | 0.3 wt. % |
| CYAN | 0.57 | 0.14 | 0.25 | 1.34 | 114.3 | 0.3 wt. % |
| YELLOW | 0.75 | 0.19 | 0.25 | 1.37 | 117.0 | 0.3 wt. % |

A similar toner prepared with carboxyhyroxybenzylmethacrylate-salicylate (CHBM) as a chelate for attaching the charge generator had the following properties: polyethylacrylate core still gave Tg = −12.5° C. and

| | | | | | | |
|---|---|---|---|---|---|---|
| YELLOW | 0.76 | 0.43 | 0.57 | 1.21 | 103.4 | 0.3 wt. % |

Yet another similar toner made with CHBM and with a polymethylacrylate core of Tg = 13° C. had properties:

| | | | | | | |
|---|---|---|---|---|---|---|
| MAGENTA | 0.52 | 0.28 | 0.54 | 1.11 | 94.9 | 0.3 wt. % |

Any selection of these liquid toners used to produce multitoned images by the methods disclosed herein was found to give very good overlay properties.

C. Preparation of Liquid Toners of the Invention

Preparation of an organosol consists of four steps:

(a) Preparation of stabilizer precurser (b) Addition reaction of a coupling reagent, e.g., hydroxyethylmethacrylate (c) latex formation by polymerization of the stabilizer (a & b above) with core monomer (d) addition of metal soap for chelation and toner charge generation.

EXAMPLE 4

This is illustrated in the preparation of a lauryl methacrylate/salicylate (CHBM) stabilizer; ethyl acrylate core latex.

Preparation of a stabilizer containing salicylic acid groups

1. Preparation of a stabilizer precurser: In a 500 ml 2-necked flask fitted with a thermometer, and a reflux condenser connected to a $N_2$ source, a mixture of 95 g of lauryl methacrylate, 2 g of 2-vinyl-4,4-dimethylazlactone (VDM), 3 g of CHBM, 1 g of azobis-isobutyronitrile (AIBN), 100 g of toluene and 100 g of ethylacetate was introduced.

The flask was purged with $N_2$ and heated at 70° C. for 8 hours. A clear polymeric solution was obtained. An IR spectra of a dry film of the polymeric solution showed an azlactone carbonyl at 5.4 microns.

2. Reaction of (1) above with 2-hydroxyethylmethacrylate (HEMA):

A mixture of 2 g of HEMA, 1.5 g of 10% p-dodecylbenzene sufonic acid (DBSA) in heptane and 15 ml of ethyl acetate was added to the polymer solution of (1) above. The reaction mixture was stirred at room temperature overnight. The IR spectra of a dry film of the polymeric solution showed the disappearance of the azlactone carbonyl peak, indicting the completion of the reaction of the azlactone with HEMA.

Ethyacetate and toluene were removed from the stabilizer by adding an equal volume of Isopar G# and distilling the ethylacetate and the toluene under reduced pressure. The polymeric solution looked turbid. The polymer solution was filtered through Whatman filter paper #2 to collect the unreacted salicylic acid. There was no remaining solid on the filter paper, indicating that all the CHBM has been incorporated. The turbidity may have been due to the insolubiltiy of the pendant salicylic groups.

Preparation of Latices

3. General Procedure:

To a 2L - 2 necked flask fitted with a thermometer and a reflux condenser connected to a $N_2$ source, were introduced a mixture of a 1200 ml of Isopar G TM, a solution of a stabilizer of the above examples containing 35 g of solid polymer, 1.5 g of AIBN and 70 g of the core monomer*. The flask was purged with $N_2$ and heated at 70° C. while stirring. The reaction temperature was maintained at 70° C. for 22 hours. A portion of the Isopar G TM was distilled under reduced pressure.

*Core monomer could be ethylacrylate, methylacrylate, or other suitable monomers.

4. Preparation of metal chelate latices (20% zirconium neodecanoate in Isopar G TM)

To a hot solution of the metal soap in Isopar G TM (reactions conditions are shown in table III) was added portionwise a latex (10% by weight in Isopar G TM) containing 1 (wt)% cf a coordinating compound equimolar with the metal soap present in the hot isopar solution. The mixture was heated for 5 hour at 60° C.

Resultant latex had a core Tg − 12.5° C. and an overall particle size = 197 +/− 47 mm.

PIGMENTS

Commercial pigments (Sun Chemical) were purified prior to dispersing with the chelate organosols. For example Sun Chem. Cyan 249-1282 was soxhlet extracted with ethanol (EtOH) or EtOH/Toluene 80/20 mix until the extracted liquid was clear (24–72 hrs). Then the solvent-wet pigment was stirred with Isopar G TM to make the percent solids 10–20%. While the slurry was stirring the temperature was kept at 75°–95° C. and $N_2$ is bubbled through for 4–6 hours to drive off any excess extraction solvents. The resultant pigment—Isopar G slurry was used for toner prepration.

TONER PREPARATION

Example 5

A weight ratio of 2:1 to 10:1 organosol to pigment was blended together and then mechanically dispersed, usually by said milling or silversion mixer. The dispersion was kept at a temperature of between 40° C. and 30° C. and normally took 4–6 hours to disperse. The resultant toner (e.g. Cyan) had the following properties.

| Particle Size | Cond(0.3% wt) | Cond Ratio | Zeta Pot |
|---|---|---|---|
| 220 +/− 40 nm | 0.9 × $10^{-11}$ mho/cm | 0.57 | 76.8 mV |

The resultant mill base had a weight percent in the range of 8–10.0%. Toners were prepared by dilution with Isopar G TM to 0.3% wt.

The preferred stabilizer precursor used in the present invention is a graft copolymer prepared by the polymerization reaction of at least two comonomers. At least one comonomer is selected from each of the groups of those containing anchoring groups, and those containing solubilizing groups. The anchoring groups are further reacted with functional groups of an ethylenically unsaturated compound to form a graft copolymer stabilizer. The ethylenically unsaturated moieties of the anchoring groups can then be used in subsequent copolymerization reactions with the core monomers in organic media to provide a stable polymer dispersion. The prepared stabilizer consists mainly of two polymeric components, which provide one polymeric component soluble in and another component insoluble in the continuous phase. The soluble component constitutes the major proportion of the stabilizer. Its function is to provide a layophilic layer completely covering the surface of the particles. It is responsible for the stabilization of the dispersion against flocculation, by preventing particles from approaching each other so that a sterically-stabilized colloidal dispersion is achieved. The anchoring group constitutes the insoluble component and it represents the minor proportion of the dispersant. The function of the anchoring group is to provide a covalent-link between the core part of the particle and the soluble component of the steric stabilizer.

Graft copolymer stabilizer precursors have been prepared by the polymerization of comonomers of unsaturated fatty esters (the solubilizing group) and alkenylazlactones (the anchoring group) of the structure

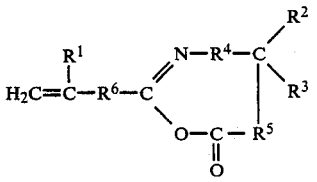

where $R^1$=H, alkyl less than or equal to $C_5$, preferably $C_1$, $R^2$, $R^3$ are independently lower alkyl of less than or equal to $C_8$ and preferably less than or equal to $C_4$, $R^4$, $R^5$ are independently selected from a single bond, a methylene, and a substituted methylene having 1 to 12 carbon atoms, $R^6$ is selected from a single bond, $R^7$, and $$-\overset{\overset{\displaystyle O}{\|}}{C}-W-R^7-$$

where $R^7$ is an alkylene having 1 to 12 carbon atoms, and W is selected from 0, S and NH, in a non-polar organic liquid, preferably an aliphatic hydrocarbon, in the presence of at least one free radical polymerization initiator. The azlactone constitutes from 1–5% by weight of the total monomers used in the reaction mixture.

Examples of comonomers contributing solubilizing groups are lauryl methacrylate, octadecyl methacrylate, 2-ethylhexylacrylate, poly(12-hydroxystearic acid), PS 429 (Petrarch Systems, Inc., a polydimethylsiloxane with 0.5–0.6 mole % methacryloxypropylmethyl groups, which is trimethylsiloxy terminated).

When polymerization is terminated, the catalyst (1–5 mole % based on azlactone) and an unsaturated nucleophile (generally in an approximately equivalent amount with the azlactone present in the copolYmer) are added to the polymer solution. Adducts are formed of the azlactone with the unsaturated nucleophile containing hydroxy, amino, or mercaptan groups. Examples of suitable nucleophiles are 2-hydroxyethylmethacrylate
3-hydroxypropylmethacrylate
2-hydroxyethylacrylate
pentaerythritol triacrylate
4-hyroxybutylvinylether
9-octadecen-l-ol
cinnamyl alcohol
allyl mercaptan
methallylamine The mixture is well stirred for several hours at room temperature. Catalysts for the reaction of the azlactone with the nucleophite that are soluble in aliphatic hydrocarbons are preferred. For example p-dodecylbenzene sulfonic acid (DBSA) has good solubility in hydrocarbons and was found to be a very effective catalyst with hydroxyfunctional nucleophiles. In the case of immiscible nucleophiles such as hydroxyalkylacrylate, strong stirring is sufficient to ensure emulsification of the nucleophile in the polymer solution. The completion of the reaction is detected by taking the IR spectrum of successive samples during the reaction period. The disappearance of the azlactone carbonyl characteristic absorption at a wavelength of 5.4 microns is an indication of 100% conversion.

The azlactone can be employed in the preparation of graft copolymer stabilizers derived from poly(12-hydroxystearic acid) (PSA). This may be achieved by reacting the terminal hydroxy group of PSA with for example 2-vinyl-4,4-dimethyl-2-oxazolin-5-one (VDM) to give a macromonomer, and then copolymerizing the latter with methyl-methacrylate (MMA) and VDM in the ratio of nine parts of MMA to one of VDM, followed by the reaction of a proportion of the azlactone groups with an unsaturated nucleophile, such as 2-hydroxyethylmethacrylate (HEMA).

The preparation of latices (organosols), by using graft copolymer stabilizers containing azlactone as anchoring sites, can be achieved using any type of known polymerization mechanism free radical, ionic addition, condensation, ring opening and so on. The most preferred method is free radical polymerization. In this method, a monomer of acrylic or methacrylic ester together with the stabilizer and an azo or peroxide initiator is dissolved in a hydrocarbon diluent and heated to form an opaque white latex. Particle diameters in such latices have been found to be well below a micron and frequently about 0.1 micron.

Example I

A. Preparation of a stabilizer precursor based on poly(2-ethylhexyl acrylate-co-VDM) 98:2 w/w In a 500 ml 2-necked flask fitted with a thermometer, and a reflux condenser connected to a $N_2$ source, were introduced a mixture of 98 g of 2-ethylhexylacrylate, 2 g of VDM , 1 g of azobisisobutyronitrile (AIBN) and 200 g of Isopar G TM (a mixture of aliphatic hydrocarbons marketed by Exxon and having high electrical resistivity, dielectric constant below 3.5, and boiling point in the region of 150° C.). The flask was purged with $N_2$ and heated at 70° C. After about 10 minutes of heating, an exothermic polymerization reaction began and the reaction temperature climbed to 118° C. The heating element was removed, and the reaction mixture was allowed to cool down without external cooling. When the reaction temperature dropped to 65° C., the heating element was replaced and the reaction temperature was maintained at that temperature over-night and the reaction mixture was then cooled to room temperature. A clear polymeric solution was obtained. An IR spectrum of a dry film of the polymeric solution showed an azlactone carbonyl peak at 5.4 microns.

B. Preparation of graft copolymer stabilizer by reacting the result of A above with 2-hydroxyethyl methacrylate (HEMA).

A mixture of 2 g of HEMA, 1.5 g of 10% p-dodecylbenzene sulfonic acid in heptane and 15 ml of ethylacetate was added to the polymer solution of (A) above. The reaction mixture was stirred at room temperature over-night. An IR spectrum of dry film of the polymeric solution showed the disappearance of the azlactone carbonyl peak.

C. Preparation of polyvinylacetate latex using stabilizer B above.

In a 250 ml 2-necked flask fitted with a thermometer and a reflux condenser connected to a $N_2$ source was placed 70 g of Isopar G TM, 11 g of stabilizer B above, 0.5 g of AIBN and 33.3 g of vinylacetate. The stirred reaction mixture was heated gently to 85° C. under $N_2$ atmosphere. After 10 minutes of heating, an exotherm started and the temperature climbed to 100° C. A small amount of petroleum ether was added to lower the reaction temperature to 85° C. Heating was continued for 3 hours, then 200 mg of AIBN was added and the reaction temperature was maintained at 85° C. for 3 hours. A portion (about 20 ml) of the Isopar G TM was distilled off under reduced pressure. A white latex with particle size of 0.18±0.05 micron was obtained.

D. Preparation of polyethylacrylate latex using stabilizer (B) above

In a 1 liter 2-necked flask fitted with a thermometer and a reflux condenser connected to a $N_2$ source, was introduced a mixture of 425 g of Isopar G TM, 50 g of stabilizer (B) above, 35 g of ethylacrylate and 0.5 g of AIBN. The flask was purged with $N_2$ and heated at 70° C. while stirring. The reaction temperature was maintained at 70° C. for 12 hours. A portion of Isopar G TM was distilled off under reduced pressure.

A white latex with particle size of 96 nm±15 nm was obtained.

E. Preparation of polymethacrylate latex using stabilizer B above.

This latex was prepared as in D above using methylacrylate instead of ethylacrylate.

F. Preparation of polymethylmethacrylate latex using stabilizer B above.

This latex has been prepared by two methods.

Method-1

As in D above, using methylmethacrylate instead of ethylacrylate.

Method-2

A 250 ml 3-necked flask fitted with a thermometer, reflux condenser and dropping funnel was charged with:

Seed stage—a mixture of:

12 g of methylmethacrylate (MMA)
11 g of stabilizer of example IB
200 mg of AIBN
5 g of Isopar G TM
30 ml of petroleum ether 35°-60° C.

The stirred mixture was heated to reflux at 81±° C. The temperature was maintained by evaporating or adding petroleum ether as necessary. After 15 min. of refluxing, the mixture turned white, indicating that a latex particle formation had occurred, after which the following mixture was added:

Feed stage—a mixture of:

20 g MMA
5 g stabilizer of example IB
120 mg AIBN
0.2 g lauryl mercaptane (10% in Isopar G TM)
10 g Isopar G TM
7 g petroleum ether 35°-60° C.

The mixture was added at a constant rate over a period of 3 hours. After the addition was finished, refluxing was continued for another half hour. After cooling to room temperature, the petroleum ether was distilled off under reduced pressure. The resulting product was a white latex with a particle size of 0.15±0.05 micron.

Example II

A. Preparation of a stabilizer precurser based on poly (Laurylmethacrylate-co-VDM) 96:4 w/w In a 500 m) 2-necked flask fitted with a thermometer and a reflux condenser connected to a N2 source, was introduced a mixture of 96 g of laurylmethacrylate, 4 g of VDM, 1 g of AIBN and 200 ml ethylacetate. The flask was purged with $N_2$ and heated at 70° C. for 12 hours. An IR spectrum of a dry film showed an azlactone carbonyl peak at 5.4 micron.

B. Preparation of graft copolymer stabilizer by reacting a portion of the azlactone groups with HEMA and the remainder with a different nucleophile 1. Attaching a nucleophile of coordinating compound:

a. Attaching 2-hydroxyethylsalicylate: A mixture of 1.4 g of HEMA, 3.27 g of 2-hydroxyethylsalicylate and 2 g of 10% DBS in heptane was added to the polymeric solution of example II A above and the reaction mixture was stirred over-night at room temperature. An IR spectrum of a dry film of the polymeric solution showed the disappearance of 95% of the azlactone carbonyl-only. The primary hydroxy groups of the salicylate compound apparently participate in the reaction with the azlactone groups.

b. Attaching 4-hydroxyethyl-4,-methyl-2,2'-bipyridine:

Example IIB 1-a was repeated except using 0.018 mole of the bipyridine compound instead of the salicylate compounds and 0.3 g of 1,8-diazabicyclo [5,4,0] undec-7-ene as a basic catalyst instead of DBSA. After 24 hours of stirring at room temperature, an IR spectrum showed the disappearance of >85% of the azlactone carbonyl peak.

c. Attaching 4-hydroxymethylbenzo-15-crown-5

Example IIB 1-a was repeated except 0.018 mole of 4-hydroxymethylbenzo-15-crown-5 was used instead of the salicylate compound.

2. Attaching nucleophiles of chromophoric substances.

Example IIB 1-a was repeated using 0.018 mole of 4-butyl-N-hydroxyethyl-1,8-naphthalimide instead of the salicylate compound.

C. Preparation of latices from the stabilizer of example II.

Ethylacetate was removed from the stabilizer by adding an equal volume of Isopar G TM and distilling the ethylacetate under reduced pressure. A clear polymeric solution in Isopar G TM was obtained. Latices were prepared from these stabilizers according to example I-D, E, F.

Example III

This example illustrates the preparation of latex particles having attached ethylenically unsaturated groups t the soluble moiety of the particle.

A. Preparation of a stabilizer precursor based on Poly(Lauryl meth-acrylate-co-VDM) 92:8 w/w This copolymer was prepared according to example II-A from 92 g of laurylmethacrylate, 8 g VDM and 1 g of AIBN in 200 g of Isopar G TM. A clear polymeric solution was obtained.

B. Preparation of graft copolymer stabilizer by reacting a proportion of the azlactone groups with HEMA A mixture of 1.4 g of HEMA, 1 g of 10% DBS in heptane and 15 ml of ethylacetate was added to the polymeric solution of example III-A above. The reaction mixture was stirred over night at room temperature. An IR spectrum of a dry film of the polymeric solution showed a decrease in the azlactone carbonyl peak by about 25%.

C. Preparation of a latex from stabilizer B above:

This latex is prepared according to example I-D from 50 g of stabilizer B above, 35 g ethylacetate, 0.5 g of AIBN and 425 g of Isopar G TM. A white latex with particle size of 95 nm+/−5 nm was obtained. Aa portion of the Isopar G TM (about 25 ml) was distilled off.

D. Attaching pentaerythritol triacrylate

A mixture of 2 g pentaerythritoltriacrylate, 2 g of 10% DBSA in heptane and 15 ml ethylacetate was added to the polymer dispersion of C above. The mixture was stirred over night at room temperature. An IR spectrum showed the disappearance of the azlactone carbonyl peak.

What is claimed is:

1. An electrophotographic process for producing high quality full color prints wherein color separation toner images are assembled on a positively charged photoreceptor using successive liquid toning steps, comprising selecting two or more liquid toners comprising toner particles comprising a pigment particle having polymer particles on its exterior surface, said polymer particles having charge coordinating moieties extending from the surface of said polymeric particles, said toner particles being dispersed in a non-polar carrier liquid, said two or more liquid toners having (a) a ratio of conductivities of said carrier liquid in said liquid toner and of said liquid toner less than 0.6, and (b) a zeta potential of said toner particles between +60 mV and +200 mV, and carrying out the assembly of said color separation toner images on said photoreceptor using said successive liquid toning steps.

2. An electrophotographic process for producing high quality full color prints wherein color separation toner images are assembled on a positively charged photoreceptor using successive liquid toning steps, comprising selecting two or more liquid toners comprising toner particles comprising a pigment particle having polymer particles on its exterior surface, said polymer particles having charge coordinating moieties extending from the surface of said polymeric particles, said toner particles being dispersed in a non-polar carrier liquid, said two or more liquid toners having (a) a ratio of conductivities of said carrier liquid in said liquid toner and of said liquid toner less than 0.4, and (b) a zeta potential of said toner particles between +60 mV and +200 mV, and carrying out the assembly of said color separation toner images on said photoreceptor using said successive liquid toning steps.

3. An electrophotographic process as recited in claim 2 wherein said ratio of conductivities is less than 0.3.

4. An electrophotographic process for producing high quality full color prints wherein color separation toner images are assembled on a positively charged photoreceptor using successive liquid toning steps, comprising selecting two or more liquid toners comprising toner particles comprising a pigment particle having polymer particles on its exterior surface, said polymer particles having charge coordinating moieties extending from the surface of said polymeric particles, said toner particles being dispersed in a non-polar carrier liquid, said two or more liquid toners having (a) a ratio of conductivities of said carrier liquid in said liquid toner and of said liquid toner less than 0.6, (b) a zeta potential of said toner particles between +60 mV and +200 mV, and carrying out the assembly of said color separation toner images on said photoreceptor using said successive liquid toning steps, and (c) the property that a continuous film is formed on those areas of the photoreceptor where said liquid toner is deposited said film being formed at a temperature less than 25° C. and in a time after deposition of less than 20 seconds.

5. An electrophotographic process as recited in claim 2 further characterized as having (c) the property that a continuous film is formed on those areas of the photoreceptor where said liquid toner is deposited said film being formed at a temperature less than 25° C. and in a time after deposition of less than 20 seconds.

6. An electrophotographic process as recited in claim 3 further characterized as having (c) the property that a continuous film is formed on those areas of the photoreceptor where said liquid toner is deposited said film being formed at a temperature less than 25° C. and in a time after deposition of less than 20 seconds.

7. An electrophotographic process as recited in claim 1 further characterized as having (c) toner particles comprising at least one component selected from resins and polymers having a Tg less than 25° C.

8. An electrophotographic process as recited in claim 2 further characterized as having (c) toner particles comprising at least one component selected from resins and polymers having a Tg less than 25° C.

9. An electrophotographic process as recited in claim 3 further characterized as having (c) toner particles comprising at least one component selected from resins and polymers having a Tg less than 25° C.

10. The electrophotographic process of claim 7 wherein the Tg is less than −10° C.

11. The electrophotographic process as in claim 1 further comprising transferring said assembly of said color separation toner images to a receptor in at least one step without loss in color and sharpness.

12. An electrophotographic process for producing high quality full color prints wherein color separation toner images are assembled on a positively charged photoreceptor using successive liquid toning steps, comprising selecting two or more liquid toners comprising toner particles comprising a pigment particle having polymer particles on its exterior surface, said polymer particles having charge coordinating moieties extending from the surface of said polymeric particles, said toner particles being dispersed in a non-polar carrier liquid, said two or more liquid toners having (a) a substantially monodispersed toner particle size of average diameter between 0.1 and 1.5 microns, (b) a zeta potential of said toner particles between +60 mV and +200 mV, (c) a ratio of conductivities of said carrier liquid in said liquid toner and of said liquid toner less than 0.6, (d) a conductivity of said liquid toner in the range $0.10\times10^{-11}$ and $2.0\times10^{-11}$ mho.cm$^{-1}$, and (e) toner particles comprising at least one component selected from resins and polymers having a Tg less than 25° C.

13. A liquid toner for use in developing electrophotographic images of at least two assembled toner layers on a charged photoreceptor, comprising toner particles comprising a pigment particle having polymer particles on its exterior surface, said polymer particles having charge coordinating moieties extending from the surface of said polymeric particles, said toner particles being dispersed in a non-polar carrier liquid, said liquid toner having (a) a substantially monodispersed organic polymeric particle size of average diameter between 0.1 and 1.5 microns, (b) a zeta potential of said toner particles between +60 mV and +200 mV, (c) a ratio of conductivities of said carrier liquid in said liquid toner to said liquid toner of less than 0.6, and (d) a conductivity of said liquid toner in the range $0.10\times10^{-11}$ and $2.0\times10^{-11}$ mho.cm$^{-1}$, said liquid toner being capable of a continuous film on a photoreceptor where said liquid toner is deposited, said film being formed at a temperature less than 25° C. and in a time after deposition of less than 20 seconds, at a coating thickness of about 0.30 microns.

14. An electrophotographic process for producing high quality full color prints wherein color separation toner images are assembled on a positively charged photoreceptor using successive liquid toning steps, comprising selecting two or more liquid toners each comprising charge carrying toner particles comprising a pigment particle having polymer particles on its exterior surface, said polymer particles having charge coordinating moieties extending from the surface of said polymeric particles, said toner particles being organosol particles surrounding a pigment particle dispersed in a non-polar carrier liquid, said two or more liquid toners having (a) a ratio of conductivities of said carrier liquid in said liquid toner and of said liquid toner less than 0.6, and (b) a zeta potential of said toner particles between +60 mV and +200 mV, and carrying out the assembly of said color separation toner images on said photoreceptor using said successive liquid toning steps.

15. An electrophotographic process for producing high quality full color prints wherein color separation toner images are assembled on a positively charged photoreceptor using successive liquid toning steps, comprising selecting two or more liquid toners each comprising toner particles comprising organosol particles surrounding a pigment particle and having chelating moieties attached thereto, said toner particles being dispersed in a non-polar carrier liquid, said two or more liquid toners each having (a) a ratio of conductivities of said carrier liquid in said liquid toner and of said liquid toner less than 0.6, and (b) a zeta potential of said toner particles between +60 mV and +200 mV, and carrying out the assembly of said color separation toner images on said photoreceptor using said successive liquid toning steps.

16. An electrophotographic process as recited in claim 15 further characterized as having (c) the property that a continuous film is formed on those areas of the photoreceptor where said liquid toner is deposited said film is formed at a temperature less than 25° C. and in a time after deposition of less than 20 seconds.

17. An electrophotographic process as recited in claim 14 further characterized as having (c) the property that a continuous film is formed on those areas of the photoreceptor where said liquid toner is deposited said film is formed at a temperature less than 25° C. and in a time after deposition of less than 20 seconds.

18. An electrophotographic process as recited in claim 14 further characterized as having (c) toner particles comprising at least one component selected from resins and polymers having a Tg less than 25° C.

19. An electrophotographic process as recited in claim 15 further characterized as having (c) toner particles comprising at least one component selected from resins and polymers having a Tg less than 25° C.

20. An electrophotographic process as recited in claim 16 further characterized as having (c) toner particles comprising at least one component selected from resins and polymers having a Tg less than 25° C.

* * * * *

UNITED STATES PATENT AND TRADEMARK OFFICE

CERTIFICATE OF CORRECTION

PATENT NO. : 4,946,753

DATED : August 7, 1990

INVENTOR(S) : Elmasry, Kidnie and Zwadlo

It is certified that error appears in the above-identified patent and that said Letters Patent is hereby corrected as shown below:

Column 11, line 63, "G#" should be --G$^{TM}$--.

Column 16, line 30, "m)" should be --ml--.

Column 16, line 54, "4-hydroxyethyl-4,-methyl-2,2'-bipyridine" should be --4-hydroxyethyl-4'-methyl-2,2'-bipyridine--.

Signed and Sealed this

Twenty-fourth Day of December, 1991

*Attest:*

HARRY F. MANBECK, JR.

*Attesting Officer*

*Commissioner of Patents and Trademarks*